United States Patent [19]

Moeglich

[11] 4,021,319

[45] May 3, 1977

[54] ELECTROLYTIC PROCESS FOR RECOVERY OF SILVER FROM PHOTOGRAPHIC FIXER SOLUTION

[75] Inventor: Karl Moeglich, Williamsville, N.Y.

[73] Assignee: Silrec Systems, Inc., Williamsville, N.Y.

[22] Filed: Sept. 24, 1975

[21] Appl. No.: 616,121

Related U.S. Application Data

[63] Continuation of Ser. No. 550,477, Feb. 18, 1975, abandoned.

[52] U.S. Cl. ..... 204/96; 204/109

[51] Int. Cl.[2] ..... C25B 1/00

[58] Field of Search ..... 204/96, 109

[56] References Cited

UNITED STATES PATENTS

| | | | |
|---|---|---|---|
| 748,609 | 1/1904 | Hunt | 204/96 |
| 2,967,807 | 1/1961 | Osborne et al. | 204/98 |
| 3,003,935 | 10/1961 | Brown | 204/96 |
| 3,733,256 | 5/1973 | Anderson | 204/109 |
| 3,793,168 | 2/1974 | Lilly | 204/109 |

*Primary Examiner*—R. L. Andrews
*Attorney, Agent, or Firm*—LeBlanc & Shur

[57] ABSTRACT

A method of electrolytically removing silver from a photographic fixer solution comprising the steps of placing the photographic fixer solution in a cell having an anode chamber and a cathode chamber, with said chamber being separated by a diaphragm having a pore size of between about 1.0 microns to 500 microns and applying a direct current across the anode and cathode to create a current density of between about 0.001 and 5 amperes per square inch at the cathode to thereby cause argentic oxide to precipitate at the cathode and an equivalent amount of elemental sulfur to precipitate at the anode. The cell is preferably maintained at a temperature of between about 20° C. and 60° C. The cell can be operated as a flow cell by maintaining a hydraulic head between the chambers to determine the flow across the diaphragm. When the cell is operated as a flow cell, a minimum specific amount of photographic fixer must be conveyed to the cell to prevent oxidation of sulfur and escape of $SO_2$ gas.

41 Claims, 2 Drawing Figures

ELECTROLYTIC PROCESS FOR RECOVERY OF SILVER FROM PHOTOGRAPHIC FIXER SOLUTION

Figure 1:
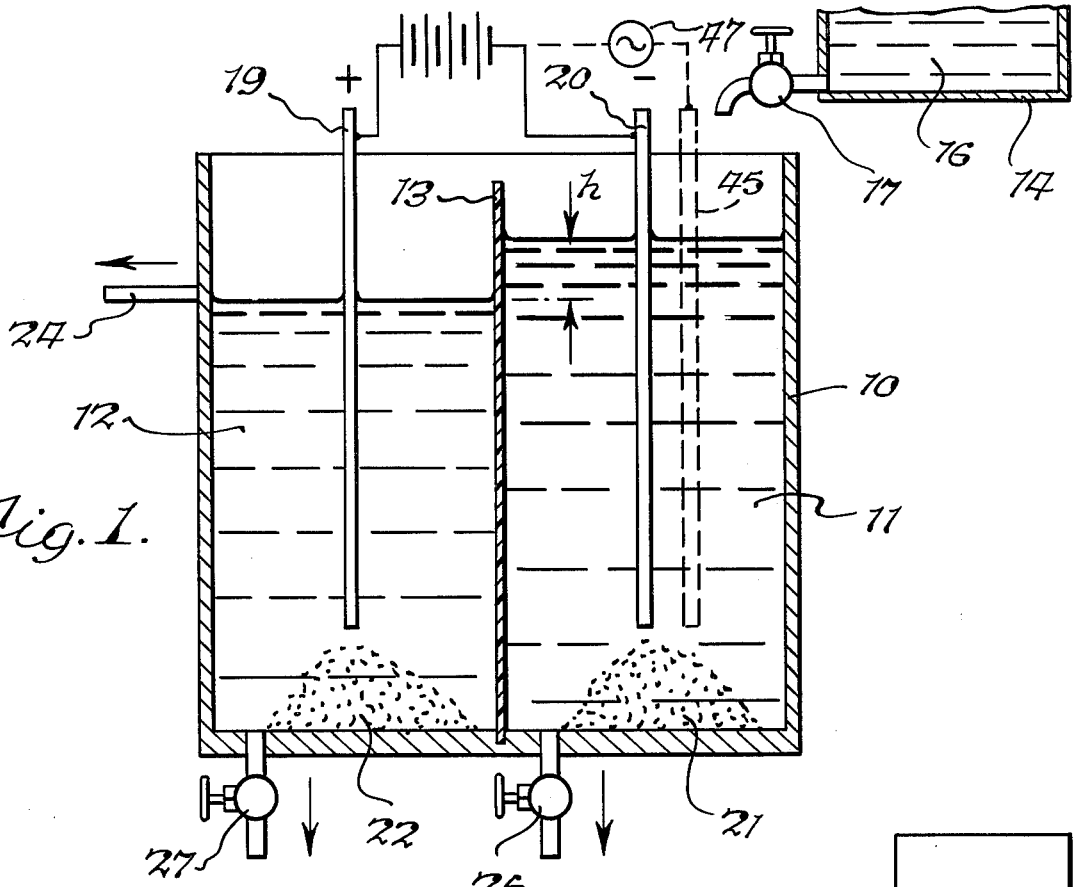

This is a continuation of application Ser. No. 550,477 filed Feb. 18, 1975, now abandoned.

The present invention relates to an improved method for recovering silver from used photographic fixer solutions.

By way of background, in the fixing of photographic film, sodium thiosulfate or analogous agents, such as potassium thiosulfate and ammonium thiosulfate, or combinations of the foregoing are used to remove the unreduced silver from the film, and this silver concentrates in the fixing bath and is also carried over to the water which is subsequently used to wash the film. The recovery of silver from used photographic solutions is very desirable for a number of reasons. First of all, the recovered silver is not only economically profitable, but it is also essential to conserving a natural resource wherein only about 65% of the silver which is used annually in industrial products is obtained from mining while the remainder must be obtained from other sources including the reclamation from industrial wastes. The photographic industry is estimated to consume approximately one-third of the total silver used by industry and therefore silver recovery from the wastes of the photographic industry comprises a significant means for conserving silver. In this respect, it is estimated that the photo-finishing, X-ray and graphic arts industries in the United States alone utilize about 2,000 tons of silver per year, and on the assumption that half of this amount remains on the photographic film or paper, then about 1,000 tons or 2,000,000 pounds of silver are dissolved by the processing solutions, and are subject to reclamation. A second extremely significant reason for recovering silver from photographic wastes is because silver is classified as a water pollutant and its salts have an extremely deleterious physiological effect. In this respect, *Lange's Handbook of Chemistry* specifies that silver is as toxic as chromium or arsenic or lead and the concentration of any of these elements in excess of 0.05 parts per million results in causing water to be unsuitable for drinking purposes.

In the past, various processes were considered for use in reclaiming the silver from spent photographic fixing solutions. Certain of these processes were not practical from a commercial viewpoint. Still other processes were only able to recover up to 90% of the silver from the spent photographic fixing solution, thereby permitting an estimated 100 tons, or 200,000 pounds of silver to be dumped in the United States with its attendant economic loss and polluting effect, considering that 0.05 parts per million causes water to be unsuitable for drinking purposes. Other processes were economically undesirable because of the initial cost of the equipment or the cost of maintenance, or the cost of operation, or because of the fact that their productivity was not sufficiently high to warrant commercial usage.

In addition, the present methods for commercial recovery of silver do not adequately break down the sulfur compounds which are present in the fixer solution, these compounds being objectionable from a pollution viewpoint because they create an oxygen demand by their slow oxidation and under certain circumstances also react to form foul smelling and dangerous compounds. Therefore, considering that at least 2,000,000 pounds of silver are present in fixer solutions, as discussed above, there must also be an equivalent amount of sulfur compounds which are not treated but are disposed of to produce the undesirable oxygen demand noted above.

Representative of the prior art methods of treating photographic fixing baths tc reclaim silver are U.S. Pat. Nos. 1,954,316, 1,937,179, 3,642,594, 3,705,716 and 3,793,168. However, basically there are three methods for recovering silver from photographic processing solutions: namely, chemical precipitation, metallic replacement, and electrolytic treatment. The chemical precipitation method comprises the addition of a suitable chemical to a spent fixing solution to precipitate a silver compound which is removed by sedimentation or filtration. The most common way is to add sodium sulfide to cause silver to precipitate as silver sulfide. While this process is 100% efficient, economical and is a simple non-electrical system, there are certain disadvantages, namely: the settling times are very long and filtration is difficult which makes the processes not particularly suited to large installations; the process is hazardous because of possible accidental acidification and liberation of hydrogen sulfide; and finally the thermal decomposition of the silver sulfide into silver produces sulfur-containing air pollutants.

The metallic replacement method operates by causing a metal such as iron, zinc, copper or aluminum to replace silver ions in solution which causes the silver to become solid metal. Steel wool is most often used. While this method has the advantages of utilizing inexpensive equipment and while it requires a simple non-electric installation, it has the disadvantages of removing only 95% of the silver under the most ideal conditions and generally removes less than 90%. This method consumes other raw materials during the course of recovery and may convert them to dangerous pollutants. In addition, it is concentration-dependent, and the effective pH range is restricted between 4 and 6.5. In addition, it requires constant testing by an operator.

Various electrolytic methods have been used to remove silver from photographic fixing solution. In one method two electrodes are placed in contact with the silver solution without a separating diaphragm therebetween and silver sulfide is formed at the cathode. In addition, hydrogen sulfide and sulfur dioxide gases are generated. This method is not considered acceptable because of the generation of those gases and further because of the subsequent air pollution which is caused by decomposing the silver sulfide by heating. Another electrolytic method utilizes an open cell having electrodes placed within the electrolyte and metallic silver is plated on a revolving cathode with a purity of about 90%. This process is undesirable because the current must be carefully controlled to prevent the formation of silver sulfide, hydrogen sulfide and sulfur dioxide, the electrolyte must be agitated to furnish a continuous supply of silver ions to a cathode and the cell current has to be regulated proportionately to the silver content. In addition, the plating equipment is expensive, the recovery efficiency is not greater than 85% and this process does not work on all types of fixers, such as bleach-fixer baths.

It is accordingly one important object of the present invention to provide an improved process which is capable of removing 100% of the silver from solutions associated with photographic fixing in a relatively simple manner and which also removes an amount of elemental sulfur equivalent to the amount of silver which has been removed, thereby not only reclaiming an amount of silver previously unreclaimable by the use of certain prior art processes with the attendant economic saving and lessening of pollution, but also removing elemental sulfur from the waste water which would have in its compound form an undesirable oxygen demand if it were to remain in the disposed solution.

Another object of the present invention is to provide an improved method which is capable of reclaiming 100% of the dissolved silver is a used photographic fixing solution in an extremely economical manner wherein the economic value of the reclaimed silver is much higher than the cost of reclaiming it, thereby causing the process to be extremely feasible and desirable from a commercial viewpoint.

A further object of the present invention is to provide an improved process for reclaiming silver from used photographic fixing solutions which can be used equally well in small installations using small amounts of fixing solutions and is extremely large installations using extremely large amounts of fixing solution.

Yet another object of the present invention is to provide an improved process for reclaiming silver from used photographic fixing solution wherein the silver is reclaimed in the form of argentic oxide which can be used in certain applications in the form in which it is reclaimed or which can be reduced to pure metallic silver by heating without polluting the atmosphere. Other objects and attendant advantages of the present invention will readily be perceived hereafter.

The present invention relates to a method of electrolytically removing silver from a photographic fixer solution comprising the steps of placing said photographic fixer solution in a cell having an anode chamber containing an anode and a cathode chamber containing a cathode with said chambers being created by a diaphragm having a pore size of a proper magnitude which will aid in creating a caustic condition in the cathode compartment, and applying a direct current across said anode and said cathode to create a current density of sufficient magnitude at said cathode to cause argentic oxide to precipitate at said cathode.

Figure 2:
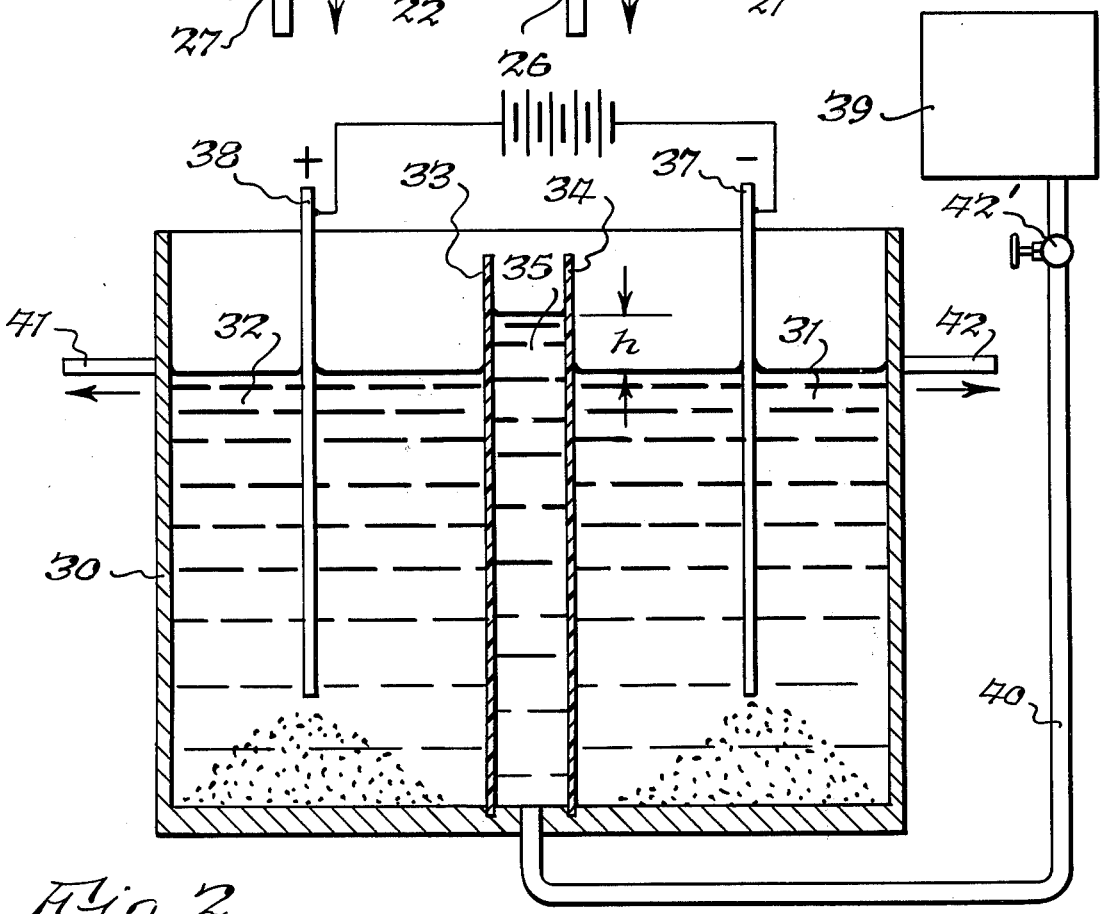

The various aspects of the present invention will be more fully understood when the following portions of the specification are read in conjunction with the accompanying drawings wherein:

FIG. 1 is a schematic representation of one form of the present invention utilizing a single diaphragm separating the anode and the cathode compartments of an electrolytic cell; and FIG. 2 is a schematic view of a modified form of the present invention utilizing two spaced diaphragms.

One form of apparatus for practicing the method of the present invention is shown in FIG. 1 and it includes a cell or tank 10 having a cathode compartment 11 separated from an anode compartment 12 by a permeable diaphragm 13. Tank 10 is preferably fabricated from an inert insulator material, such as glass, plastic or ceramic material. A storage tank 14 contains used photographic fixing solution 16 and supplies it to cathode chamber 11 when valve 17 is opened. The used photographic fixing solution contains sodium ions, ammonium ions, thiosulfate ions, silver ions and bromine ions.

Summarizing in advance, after the tank 10 has been filled with spent fixer solutions, such as sodium, ammonium, or potassium thiosulfate, or combinations thereof, argentic oxide 21 will precipitate in cathode compartment 11 and an equivalent amount of elemental sulfur 22 will precipitate in anode compartment 12 as a result of applying a direct current across anode 19 and cathode 20. In the foregoing respect, when operating as a batch process, it is preferable to place the fixer in the cathode compartment and place water in the anode compartment. However, the batch process will also operate if fixer is placed in both compartments, but unwarranted by-products, such as $SO_2$ or $Ag_2S$, may be formed in the anode compartment. After the desired amount of silver in the form of argentic oxide has been removed from solution, which is preferably 100%, valve 26 will be opened to drain the cathode compartment and valve 27 will be opened to drain the anode compartment. The precipitates, namely S and AgO, will be separated from solution by filtration or the like before the solution is disposed of. Thereafter valve 17 will be opened to add a new supply of fixer solution from tank 14 to cell 10. Thus silver can be removed by a batch treatment process. The foregoing description applies to a batch process with the understanding that no head *h* exists between the compartments and there is no outflow from conduit 24. When operating as a batch process, there is the possibility that $SO_2$ gas may be given off from the solution if the solution is not sufficiently dilute, or other unwanted by-products may be formed.

Cell 10 is preferably operated as a continuous flow cell wherein the flow is at a rate which permits removal of 100% of the silver in the used or spent fixer as argentic oxide. When operating as a continuous flow cell, valve 17 will remain at a desired open setting to provide the required rate of flow to the inlet compartment, whether it be the anode or the cathode compartment, and the treated solution will be discharged from outlet spout such as 24 in the other compartment when there is a sufficient head on diaphragm 13 to cause the desired rate of liquid flow through the diaphragm. While FIG. 1 shows the diaphragm cell with the inflow at the cathode compartment, which is preferable, it will be appreciated that it can be operated with the inflow at the anode compartment and the discharge at the cathode compartment, in which event the various conduits would be reversed.

Electrode 20 is an electrode grade graphite plate manufactured by Great Lakes Carbon. Although graphite is chemically inert, it cannot be used successfully as an anode because of the mechanical erosion caused by oxygen. The anode 19 can be fabricated from any electrically conductive but chemically and mechanically inert material of any desired shape. Other suitable anode materials are the noble metals and ruthenium oxide coated valve metals, such as tantalum, niobium and titanium. Stainless steel is suitable for the cathode material.

Diaphragm 13 is fabricated from any chemically inert porous insulating material with a pore size preferably between 20 and 300 microns ($\mu$), but the pore size may be increased to 500 microns, but it is commercially impractical to operate above about 300 microns. In this respect it can be fabricated from any insulating material including but not limited to asbestos, fiberglass, ceramics, porous polyethylene, plastics or other materials. The thickness of the diaphragm 13 will have no influence on the process other than affecting the cell resistance. The thicker the diaphragm, the greater the voltage that will be required to produce the desired current. If the pores in the diaphragm are less than 1 micron, over a period of time fouling of the diphragm by the deposition of solid products in the pores will generally take place. However, the process can still work with smaller pores as long as there can be ion migration through the boundary layer in the pores. In addition, the pore size must be large enough to prevent blockage by AgO if flow is from the cathode compartment to the anode compartment and to prevent blockage by sulfur if flow is from the anode compartment to the cathode compartment. If the diaphragm should be fouled by either sulfur or argentic oxide, the ionic mass transfer and therefore the efficiency of the cell will be lowered. In addition, if there is deposition of sulfur or argentic oxide on the diaphragm, there will be a sufficiently high potential gradient across each respective interface to cause the formation of hydrogen sulfide or sulfur dioxide. The lower range of the pore size of the diaphragm is $1.0\mu$ The upper range is set by a pore size large enough to allow a flow which could alter the cell reactions if not compensated for by an increased electric field. This upper range for practical purposes is about $500\mu$. The preferred range is between $29\mu$ and $300\mu$, and the especially preferred range is between $50\mu$ and $120\mu$.

The current density applied across electrodes 19 and 20 may range between 0.001 amperes per square inch to 5 amperes per square inch for practical reasons. Actually there is no upper limit of current other than as limited by the temperature or the heating of the electrolyte. Furthermore, the current density should be below that which will cause breakdown of the electrolyte at the electrode interfaces in an undesired manner. The range of current density is more preferably between 0.1 to 1 ampere per square inch and most preferably between about 0.3 and 0.8 amperes per square inch.

The cell 10 will operate at a temperature from melting point up to about 90° C. However, the preferred range is between room temperature, which is about 20° C., and 60° C., and the especially preferred temperature of operation is between about 20° C. and 45° C. At temperatures above about 60° C., there will be a release of sulfur compounds which have an objectionable odor. However, the process will operate satisfactorily otherwise.

Insofar as the chemical composition of the fixer and the silver content is concerned, fixers containing sodium thiosulfate, potassium thiosulfate, ammonium thiosulfate, and combinations thereof, and of any silver concentrations can be treated to remove 100% of the silver in the form of argentic oxide.

The functioning of cell 10 with fixers of the compositions described in the preceding paragraph is satisfactory without any pH adjustment.

In order to have cell 10 function in an optimum manner there must be a minimum specific flow rate. The specific flow rate is expressed in cubic centimeters of flow per current unit per square inch of cathode area. It should be of a magnitude to provide a sufficient amount of silver ions to the cathode interface for the necessary formation of AgO. If this is not the case, unwanted byproducts, such as $H_2S$, $SO_2$ and $Ag_2S$ are formed. The minimum flow rate for saturated fixer having a silver content measured as 1.2 cubic centimeters of silver sulfide (the amount of silver sulfide obtained from ten cubic centimeters of fixer after centrifuging with ammonium sulfide as a reagent) is 3.8 – 4.0 cubic centimeters per ampere hour for a current density of 1 ampere per square inch of cathode area. For fixers with a silver content other than stated, the flow rate changes inversely with the concentration and the upper limit is set by the required complete depletion of silver under selected cell conditions, such as current density and thermal limits. In an open cell, hydrogen ions formed at the cathodic interface will decompose thiosulfate to form hydrogen sulfide. This will combine with either silver ions or already plated out silver to form silver sulfide. In the present invention, a diaphragm is inserted between the anode and cathode, which together with the electric field, assorts and separates the ions by charge. An alkaline condition in the cathode compartment is developed. This depresses the hydrogen sulfide formation and allows the silver ions to react with the hydroxyl ions formed cathodically. Most metal cations would form the hydroxide under these conditions. Instead of the expected silver hydroxide, which is known to be unstable, silver oxide is formed. It cannot be explained why under these conditions argentic oxide is formed.

Further in the foregoing respect, there are three factors which affect the operation of the cells such as shown in FIGS. 1 and 2. These factors are (1) the pore size and pore distribution of the diaphragm, and (2) the cell current (3) the hydraulic head between the compartments for flow cell conditions, and (4) the temperature of the electrolyte, especially at the interface. The importance of the foregoing factors is to maintain the proper cell conditions so that AgO is formed.

The pore size restricts flow between the compartments so as to aid in maintaining proper pH differential between the compartments. In this respect, the area surrounding the cathode must remain sufficiently caustic for the formation of AgO. The amount of diffusion of the ions through the diaphragm varies with the pore size and above a certain pore size, the diffusion will be sufficiently great so that the proper pH cannot be maintained at the cathode because there would be a sufficient migration of anions into the cathode compartment which would cause the formation of $Ag_2S$ at the cathode. In addition, as the pore size increased beyond 300$\mu$, there has to be an increase in current which may heat the cell objectionably high, or if the current is not increased, open cell operation (that is, without a diaphragm) will be approached so that silver sulfide will be formed. In this respect, above a pore size of 300$\mu$, the alkaline environment at the cathode starts to diminish drastically, and has to be counteracted by increasing the electric field so that it remains sufficiently alkaline for operability up to a pore size of $500\mu$. While there can be flow through pore sizes below $20\mu$, such pores would become plugged by the precipitates, depending on the rate of flow, and such plugging would eventually stop the flow through the diaphragm.

The cell current controls the separation of the ions. In this respect, the negative ions are attracted to the anode and the positive ions are attracted to the cathode. Thus the current is a factor tending to maintain the proper caustic pH in the environment of the cathode so that AgO will precipitate. The thiosulfate ions will be attracted to the anode where the $SO_3^{--}$ forms an acidic environment, while the sodium, potassium or ammonium ions in solution will be attracted to the cathode where they will create the caustic environment to which the silver ions are attracted to be converted to AgO when the silver ions combine with the hydroxyl ions. As noted above, the current density must be sufficiently large so as to cause ionic attraction, but it cannot be so large as to heat the solution excessively.

The hydraulic head between compartments is used to cause liquid flow in the proper direction so that the cell can be operated as a continuous flow cell. The consequent directional flow is also a function of pore size and pore number. The flow can be calculated at any value which will be above the minimum specific flow rate, as defined above. However, a cell can be operated as a batch process, that is, without flow, with a pore size below 20$\mu$, subject, however, to eventual plugging resulting from the deposit of sulfur on the diaphragm. In the flow process, when the pore size is about 120$\mu$, silver sulfide starts to form, depending on the current density, and this contaminates the AgO. Over 300$\mu$pore size, the field required for sufficient current to retain the silver in the cathode compartment produces a wattage such that temperature limits tend to be exceeded. The hydraulic head across the diaphragm may be obtained by the use of any means which will produce a pressure drop across the diaphragm, and it need not be restricted to a difference in height of the liquid across the compartments, as shown.

In FIG. 2 a modified electrolytic cell 30 is shown having a cathode compartment 31, an anode compartment 32 and diaphragms 33 and 34 therebetween which are on opposite sides of central compartment 35. A cathode 37 extends into cathode compartment 31 and an anode 38 extends into anode compartment 32. An electrolyte reservoir 39 is provided with a conduit 40 leading to chamber 35 between diaphragms 33 and 34. The outflow is through outlets 41 and 42 which are in communication with the anode and cathode compartments, respectively. Suitable outlet valves, such as 26 and 27 of FIG. 1, may be used in conjunction with compartments 31 and 32 to selectively remove the precipitates in these compartments. It is to be especially noted that all the parameters discussed above relative to FIG. 1 are equally applicable to FIG. 2. It is also to be noted that there is a head *h* in between the center compartment and the outer compartments.

The operation of the cells shown in FIG. 1 may be improved by inserting an additional electrode 45 in the cathode compartment and applying alternating current across electrodes 20 and 45 as shown. The same modification can be applied to FIG. 2. The foregoing results in increased removal of silver. As can be seen from FIG. 1, the battery 15 provides the direct current to electrodes 19 nd 20 and an alternating power source 47 applies alternating current to electrodes 45 and 20. The AC and DC power sources are electrically isolated from each other. The alternating current may have a frequency of between 1 Hz and 800 Hz, and more preferably between 10 Hz and 120 Hz and most preferably about 60 Hz for practical reasons. Furthermore, the alternating current density may be between 0.1 and 20 amperes/in$^2$ and more preferably between 1 and 10 amperes/in$^2$ and most preferably between 3 and 7.5 amperes/in$^2$.

EXAMPLE I

The electrolytic cell 10 shown in FIG. 1 was fabricated from plexiglass and had a volume of 1 gallon. Diaphragm 13 was fabricated by compressing asbestos sludge to a thickness of one-half inch and a width of 8 inches and length of 8 inches and fastening it between perforated plexiglass. The porosity of the diaphragm was such that a dynamic head *h* of 2 inches was needed to produce a flow of 1 gallon of electolyte per hour. Flow of the fixer, a mixture of sodium and ammonium thiosulfate having a silver concentration of 1.2 cc of silver sulfide per 10 cc of solution, took place from the anolyte compartment through the diaphragm 13 and into the catholyte compartment from which it was removed, this being exactly opposite to that shown in FIG. 1. The silver precipitated in the catholyte compartment in the form of argentic oxide (AgO). The anode was a 6 inch by 6 inch titanium plate coated with ruthenium dioxide, having an effective area of 36 square inches. The anode is manufactured by Diamond Shamrock Co. The cathode was a graphite plate ½ inch thick, 2½ inches wide and 12 inches were immersed to produce a total projected surface area of 30 square inches. A current of 13 amperes was applied across the electrodes to produce a current density of 0.433 amperes per square inch at the cathode. A flow of 1500 cubic centimeters per hour was provided to produce a specific flow rate of 3.85 cubic centimeters per hour-ampere-square inch [3.85 =1500/(30 × 13)]. The liberation of sulfur dioxide gas were observed. There was no silver in the outflow from the cell. Argentic oxide was deposited t the cathode.

EXAMPLE II

With all conditions the same as set forth above in Example I except with a flow of 1800 cubic centimeters per hour and a current of 15 amperes (0.5 amperes per square inch at the cathode) producing a specific flow rate of 4.0 cubic centimeters per hour-ampere-square inch, no hydrogen sulfide or sulfur dioxide were noted ( 4.0 = 1800/(30 × 15)]. There was no silver in the outflow from the cell. Argentic oxide was deposited at the cathode.

EXAMPLE III

In an electrolytic cell such as described above relative to Example I, a diaphragm consisting of one-eight inch thick porous polyethylene was used with the pore size being 30 microns. The inflow was through the anode compartment, exactly opposite to that shown in FIG. 1. The silver content of the input electrolyte, a combination of sodium thiosulfate and ammonium thiosulfate, was 0.5 cubic centimeters of silver sulfide ($Ag_2S$) per 10 cc of solution as determined by the above described method. The cell was operated by impressing 9.5 volts across the electrodes while the cell was being filled, which gave a current of 15 amperes when the cell was completely filled and this produced a current density of 0.5 amperes per square inch at the cathode. The cell was then run without additional flow for 30 minutes at which time the silver content was reduced to 0.0 cubic centimeters of silver sulfide per 10 cc of solution in the cathode compartment. The current was then increased to 24 amperes to provide a current density of 0.8 amperes per square inch at the cathode. The flow was increased to 63 cubic centimeters per minute which equals 3,780 cubic centimeters per hour, which is equal to about one gallon per minute. At this flow rate, the cell was operated for 2½ hours maintaining a silver output level of 0.0 cubic centimeters of silver sulfide ($Ag_2S$) per 10 cc of solution. The final temperature of the cell was 57° C. with an average temperature of 52° C. The specific flow rate was 5.25 cubic centimeters per hour-ampere-square inch.

EXAMPLE IV

A cell was used of the type shown in FIG. 2. It included two polyethylene diaphragms of a size of 6 × 10 inches spaced one-half inch apart to produce an enclosed volume in chamber 35 of 30 cubic inches. The diaphragms 33 and 34 had a pore size of 30 microns. The anode 38 was fabricated from ruthenium dioxide coated on titanium to provide an immersed area of 6 × 6 inches, having an effective area of 36 square inches. The cathode 37 was a graphite plate ½ inch thick, 2½ inches wide and it was immersed for 9 inches of its length. The effective cathode area which was immersed was 22.5 square inches. The cell was filled with used fixer containing silver, and was a mixture of sodium thiosulfate and ammonium thiosulfate and the electrolyte of the center compartment was tested for silver. The silver test was performed with the ammonium sulfide method, explained above, and the silver content is expressed in cubic centimeters of silver sulfide per 10 cubic centimeters of fixer solution. The following table shows the removal of silver from chamber 35 as a function of time:

| Time (min.) | cc of $Ag_2S$ per 10 cc of solution |
|---|---|
| 0 | 1.2 |
| 30 | 0.7 |
| 60 | 0.5 |
| 90 | 0.4 |
| 120 | 0.3 |
| 150 | 0.2 |
| 180 | 0.1 |
| 210 | 0.05 |
| 240 | Trace |

The average current which was applied was 12.5 amperes and the average cell voltage was 6.5 volts D.C. The temperature at the end of the test was 56° C. and a temperature of about 50° C. was maintained generally during the test. The pH at the start was 6 and at the end it was 3 for the anolyte, 6 in the center compartment 35, and 8 for the catholyte. The reason for the lowering of the pH to 3 was because of the migration of $S\text{-}SO_3^-$ to the anode, and the silver equivalent S precipitating and leaving $SO_3.^-$

EXAMPLE V

In a double diaphragm cell, as described in Example IV, the silver content of the incoming electrolyte, containing sodium thiosulfate and ammonium thiosulfate was 1.2 cubic centimeters of silver sulfide ($Ag_2S$) per 10 cc of solution. The cell contents had been depleted to 0.0 cubic centimeters of silver sulfide and the flow rate was 900 cubic centimeters per hour. The applied current was 10 amperes and the silver level in the output was 0.0 cubic centimeters of silver sulfide. The specific flow rate was 4.0 cubic centimeters per hour-ampere-square inch. After several hours the current was lowered to 7.5 amperes giving a specific flow rate of 5.33 cubic centimeters per hour-ampere-square inch. The silver level in the output remained at 0.0 cubic centimeters of silver sulfide. Because the incoming electrolyte is being diluted as soon as it enters the cell, the specific flow rate can be increased in the manner shown.

EXAMPLE VI

In a two-compartment cell which was separated by a fitted glass diaphragm having a pore size of between 0.9 and 1.4$\mu$, a current of 0.1 ampere was applied across electrodes in the compartments for a period of 1.5 hours. The diaphragm provided an area of 6.2 square inches. The cathode was a ¼ inch carbon rod immersed for 2 inches. The anode was ruthenium oxide coated titanium having an area of approximately 2 square inches. The current density at the anode was therefore 0.05 ampere per square inch and the current density at the cathode was 0.13 ampere per square inch. The cell was operated as a batch cell and therefore there was no hydraulic head across the compartments. The original concentration of silver in the fixer in the cathode compartment was 0.4 cubic centimeters of silver sulfide per 10 cc of solution. The fixer solution was a mixture of sodium and ammonium thoisulfate containing bromine ions in addition to the silver ions. After 1.5 hours of cell operation, the concentration of silver in the cathode compartment was 0.24 cubic centimeters of silver sulfide per 11 cc of solution. At the start of the test there were 250 cc of distilled water in the anode compartment of 250 cc of fixer of the above concentration in the cathode compartment. At the end of the test there was 110 cc of solution in the anode compartment and 360 cc of solution in the cathode compartment, and this was due to catholytic water migration caused by hydration of cations. There was no concentration of silver in the anode compartment at the end of the test. The precipitate in the cathode compartment was AgO.

EXAMPLE VII

A batch type cell was provided having an anode compartment separated from a cathode compartment by means of a diaphragm of porous polyethylene having a pore size of 100$\mu$. In the cathode compartment was 175 cc of the same used fixer described in Example VI containing 0.4 cubic centimeters of silver sulfide per 10 cc of solution. The anode compartment contained 175 cc of distilled water. One ampere of current was applied across the electrodes for a period of one hour. The electrode material was the same as set forth above in Example VI. The diaphragm area was 5.2 square inches. The current density was 0.5 ampere per square inch at the anode and 1.3 amperes per square inch at the cathode. At the end of the test there was a precipitate of silver oxide in the cathode compartment but the solution contained no silver ions. However, esting of the anolyte indicated a concentration of silver in the amount of 0.13 cc of silver sulfide per 10 cc of solution, thereby indicating a migration of silver ions into the anode compartment.

EXAMPLE VIII

In the same type of cell as set forth in Examples VI and VII, the anode and cathode compartments were separated by a porous polyethylene diaphragm having a pore size of 200$\mu$. 263 cc of distilled water was placed into the anode compartment and 300 cc of the same used fixer described in Example VI was placed in the cathode compartment. The used fixer contained sodium and ammonium thiosulfate and also contained silver and bromide ions. The diaphragm had an area of 9.2 square inches. The fixer originally had a silver concentration of 0.4 cubic centimeters of silver sulfide per 10 cc of solution. One ampere of current was aplied across the electrodes for a period of one hour. The electrode material and size was the same as in Examples VI and VII. Therefore, there was a current density of 0.5 ampere per square inch at the anode and a current density of 1.3 amperes per square inch at the cathode. At the end of the test the silver concentration in the cathode compartment was 0.01 cc of silver sulfide per 10 cc of solution and the silver concentration in the anode compartment was 0.2 cc of silver sulfide per 10 cc of solution. There was a precipitate of AgO in the cathode compartment.

EXAMPLE IX

A cell was provided, such as shown in FIG. 1, with an additional electrode in the cathode compartment. A porous polyethylene diaphragm having a pore size of 100$\mu$ separated the anode and the cathode compartments. Each compartment contained 175 cc of used fixer consisting of a mixture of sodium and ammonium thiosulfate and this fixer also contained silver and bromide ions. The fixer had an original silver concentration of 0.4 cc $Ag_2S$ per 10 cc of fixer. The DC anode was ruthenium oxide coated titanium and was immersed for an area of 2 inches by ½ inch. The cathode was a ¼ inch diameter graphite rod immersed 2 inches into the solution. In addition, the additional electrode in the cathode compartment was of the same dimensions as the cathode and of the same material. The AC and DC power supplied, which were hooked up in the maner shown in FIG. 1, were electrically isolated. The applied DC current was 1 ampere and was applied for 30 minutes to provide a current density at the anode of 1 ampere per square inch and at the cathode a current density of 0.8 amperes per square inch. From the following table it can be seen that the silver removal is greater with the superimposed AC current than without it. In addition, the anodic migration of silver is diminished. Furthermore, odors are suppressed by the use of cathodically superimposed alternating current if the DC diaphragm cell is operated outside of preferred limits so that it would otherwise develop objectionable odors. The cell was operated as a batch process.

| AC Current (A) | pH Final Anolyte | pH Final Catholyte | Ag+ Anolyte $cm^3/Ag_2S$ | Ag+ Catholyte $cm^3/Ag_2S$ |
|---|---|---|---|---|
| — | 3 | 4 | 0.38 | 0.18 |
| 0.8 | 3 | 5 | 0.35 | 0.16 |

It can thus be seen that the method of the present invention possesses certain advantages over the commercially used silver recovery methods. In this respect the method of the present invention removes silver entirely. In addition, silver is precipitated as silver oxide and simultaneously an amount of sulfur equivalent to the silver is precipitated in pure elemental form. The process is extremely simple and no labor is involved. There are no movable parts in the aparatus and therefore there is no requirement for maintenance. The installations such as shown in FIGS. 1 and 2 can be made in any desired size to service small or large users of photographic fixing solution. The process is not sensitive to pH or current density, within reasonable limits, and thus no monitoring is needed for reliable operation. The argentic oxide which is produced is pure and may be a desirable industrial product by itself or this oxide can be easily and economically converted into pure silver at only half the smelting heat of the metal or that required for the removal of the sulfide which may be occluded in plated siler. In addition, the reduction of the silver oxide to the pure metal is non-polluting because it is oxygen which is given off rather than sulfur or a sulfur product which would be the case with silver sulfide. The initial equipment cost is low and therefore is economically within the range of practically all users of photographic fixing solution.

While preferred embodiments of the present invention have been disclosed, it will be appreciated that it is not limited thereto but may be otherwise embodied within the scope of the following claims.

What is claimed is:

1. A method of electrolytically removing silver from a photographic fixer solution comprising the steps of placing said photographic fixer solution in a cell having an anode chamber containing an anode and a cathode chamber containing a cathode with said chambers being created by a diaphragm having a pore size of a proper magnitude which will aid in creating a caustic condition in the cathode compartment, and applying a direct current across said anode and cathode to create a current density of a sufficient magnitude at said cathode to cause argentic oxide to precipitate at said cathode.

2. A method as set forth in claim 1 wherein said pore size is between about 20$\mu$ and 300$\mu$.

3. A method as set forth in claim 2 wherein said current density at said cathode is between about 0.1 and 1 ampere per square inch.

4. A method as set forth in claim 2 wherein said current density at said cathode is between about 0.3 and 0.8 ampere per square inch.

5. A method as set forth in claim 2 wherein said current density at said cathode is between about 0.001 and 5 amperes per square inch.

6. A method as set forth in claim 1 including the step of maintaining a positive hydraulic pressure between said anode chamber and said cathode chamber so as to create a flow through said cell, and flowing the photographic solution into the compartment of said cell having the higher hydraulic pressure and withdrawing the liquid from the other compartment of said cell.

7. A method as set forth in claim 6 wherein said current density at said cathode is between about 0.001 and 5 amperes per square inch.

8. A method as set forth in claim 7 wherein said pore size is between about 20$\mu$ and 300$\mu$.

9. A method as set forth in claim 7 wherein said pore size is between about 50$\mu$ and 120$\mu$.

10. A method as set forth in claim 6 wherein said pore size is between about 50$\mu$ and 120$\mu$.

11. A method as set forth in claim 10 wherein said current density at said cathode is between about 0.1 and 1 ampere per square inch.

12. A method as set forth in claim 10 wherein said current density at said cathode is between about 0.3 and 0.8 ampere per square inch.

13. A method as set forth in claim 1 wherein said current density at said cathode is between about 0.001 and 5 amperes per square inch.

14. A method as set forth in claim 13 wherein said pore size is between about 20 and 300$\mu$.

15. A method as set forth in claim 13 wherein said pore size is between about 50$\mu$ and 120$\mu$.

16. A method as set forth in claim 1 wherein said current density at said cathode is between about 0.3 and 0.8 ampere per square inch.

17. A method as set forth in claim 16 wherein said pore size is between about 50$\mu$ and 120$\mu$.

18. A method as set forth in claim 16 including the step of maintaining the temperature of said cell at between about 20° C. and 60° C.

19. A method as set forth in claim 16 including the step of maintaining the temperature of said cell at between about 20° C. and 45° C.

20. A method as set forth in claim 1 including the step of providing an additional electrode in said cathode chamber, and applying alternating current across said cathode and said additional electrode.

21. A method as set forth in claim 20 wherein said pore size is between about 50$\mu$ and 120$\mu$.

22. A method as set forth in claim 21 wherein the direct current density at said cathode is between about 0.1 and 1 ampere per square inch.

23. A method as set forth in claim 1 wherein a minimum specific amount of said photographic fixer is conveyed to said cell to prevent oxidiation of sulfur and escape of $SO_2$ gas.

24. A method as set forth in claim 23 wherein said pore size is between about 20$\mu$ and 300$\mu$ and said current density at said cathode is between about 0.001 and 5 amperes per square inch.

25. A method as set forth in claim 24 wherein said current density at said cathode is between about 0.1 and 1 ampere per square inch.

26. A method as set forth in claim 1 wherein said pore size is between about 1$\mu$ and 500$\mu$.

27. A method as set forth in claim 1 wherein said pore size is between about 50$\mu$ and 120$\mu$.

28. A method as st forth in claim 1 wherein said current density at said cathode is between about 0.1 and 1 ampere per square inch.

29. A continuous method for electrolytically processing a photographic fixer solution to remove silver therefrom comprising the steps of:

providing a cell having an anode chamber containing an anode and a cathode chamber containing a cathode with said chambers being created by a diaphragm having a pore size of a predetermined magnitude disposed therebetween, said chambers adapted to contain photographic fixer solution;

continuously supplying photographic fixer solution to said cell;

maintaining a positive hydraulic pressure across said diaphragm to ensure a flow therethrough;

maintaining a caustic condition in the cathode chamber and applying a direct current across said anode and cathode to create a current density of a sufficient magnitude at said cathode to cause argentic oxide to precipitate at said cathode for collection; and continuously withdrawing said processed solution from said cell.

30. The method of claim 29 wherein said diaphragm comprises a pair of mutually spaced diaphragm members, said method further comprising maintaining fixer solution at a first predetermined level in said chambers; and maintaining fixer solution at a second predetermined level between said members whereby a constant hydraulic pressure is maintained across said diaphragm.

31. The method of claim 30 wherein said current density at said cathode is between about 0.001 and 5 amperes per square inch.

32. The method of claim 31 wherein said direct current density at said cathode is between about 0.1 and 1 amperes per square inch.

33. The method of claim 31 wherein said pore size is between about 20 and 300.

34. The method of claim 31 wherein said pore size is between about 50 and 120.

35. The method of claim 30 including the step of providing an additional electrode in said cathode chamber, and applying alternating current across said cathode and said additional electrode.

36. The method of claim 29 further comprising maintaining said fixer solution at a first predetermined level in said cathode chamber and at a second predetermined level in said anode chamber whereby a constant hydraulic pressure is maintained across said diaphragm.

37. The method of claim 36 wherein said current density at said cathode is between about 0.001 and 5 ampere per square inch.

38. The method of claim 37 wherein the direct current density at said cathode is between about 0.1 and 1 ampere per square inch.

39. The method of claim 37 wherein said pore size is between about 20 and 300.

40. The method of claim 37, wherein said pore size is between about 50 and 120.

41. The method of claim 36 including the step of providing an additional electrode in said cathode chamber, and applying alternating current across said cathode and said electrode.

* * * * *